US006570499B2

(12) United States Patent
Kaganer

(10) Patent No.: US 6,570,499 B2
(45) Date of Patent: May 27, 2003

(54) HOUSEHOLD SECURITY AND SURVEILLANCE SYSTEM UTILIZING A VIDEO RECORDER

(76) Inventor: Victor Kaganer, 104 Regis Ct., Paramus, NJ (US) 07652

( * ) Notice: Subject to any disclaimer, the term of this patent is extended or adjusted under 35 U.S.C. 154(b) by 0 days.

(21) Appl. No.: 09/784,785

(22) Filed: Feb. 20, 2001

(65) Prior Publication Data

US 2002/0113697 A1 Aug. 22, 2002

(51) Int. Cl.[7] ..... G08B 13/00
(52) U.S. Cl. ..... 340/541; 340/691.8
(58) Field of Search ..... 340/541, 540, 340/522, 692, 384.3, 825.3, 545.9, 521, 528, 566, 567, 825.69, 825.72, 539, 691.8; 348/152, 154

(56) References Cited

U.S. PATENT DOCUMENTS

| | | | | | |
|---|---|---|---|---|---|
| 4,370,675 | A | | 1/1983 | Cohn | 358/108 |
| 4,383,744 | A | | 5/1983 | O'Connell | 354/81 |
| 4,525,047 | A | | 6/1985 | Myers | 354/173 |
| 4,645,919 | A | | 2/1987 | McCaleb | 250/214 |
| 4,651,143 | A | | 3/1987 | Yamanaka | 340/691 |
| 4,857,912 | A | * | 8/1989 | Everett | 340/825.3 |
| 5,402,167 | A | | 3/1995 | Einbinder | 348/152 |
| 5,448,290 | A | | 9/1995 | VanZeeland | 348/153 |
| 5,448,320 | A | | 9/1995 | Sakai | 354/81 |
| 5,455,561 | A | | 10/1995 | Brown | 340/541 |
| 5,473,368 | A | | 12/1995 | Hart | 348/155 |
| 5,495,288 | A | | 2/1996 | Broady | 348/155 |
| 5,541,585 | A | * | 7/1996 | Duhame | 340/572 |
| 5,565,844 | A | | 10/1996 | Bedrosian | 340/567 |
| 5,602,585 | A | | 2/1997 | Dickinson | 348/155 |
| 5,654,750 | A | | 8/1997 | Weil | 348/143 |
| 5,657,076 | A | * | 8/1997 | Tapp | 348/154 |
| 5,793,420 | A | | 8/1998 | Schmidt | 348/148 |
| 5,819,124 | A | | 10/1998 | Somner | 396/263 |
| 5,825,413 | A | | 10/1998 | Mullis | 348/155 |
| 6,127,926 | A | * | 10/2000 | Dando | 340/541 |
| 6,172,605 | B1 | * | 1/2001 | Matsumoto | 340/500 |
| 6,204,762 | B1 | * | 3/2001 | Deromg | 340/541 |
| 6,249,225 | B1 | * | 6/2001 | Wang | 340/541 |

* cited by examiner

*Primary Examiner*—Van Trieu
(74) *Attorney, Agent, or Firm*—Boris Leschinsky

(57) ABSTRACT

A household security and surveillance system for surveillance of the protected area, having a triggering device, a controller receiving signals from the triggering device and sending signals of activation or deactivation to a video recorder through a common remote control. In the preferred embodiment, the video recorder is a household VCR. The video recorder is also connected to a video camera, providing surveillance of the protected area. The controller has solenoids L1 and L2 with corresponding plungers which activate "start" and "stop" buttons of the remote control. In one preferred embodiment, the electrical circuitry providing a "single-push" activation of the "start" button is utilized. An electrical circuitry allowing for a "double-push" activation of the "start" button may also be provided.

2 Claims, 3 Drawing Sheets

HOUSEHOLD SECURITY AND SURVEILLANCE SYSTEM UTILIZING A VIDEO RECORDER

FIELD OF THE INVENTION

The present invention relates to the field of security systems. More particularly, the present invention relates to the surveillance and security system utilizing a video camera and a household video recorder for recording of the intruder objects unexpectedly appearing in the protected area.

BACKGROUND OF THE INVENTION

Various surveillance and security systems are currently known in the art. Presently available systems typically include different types of motion detectors, i.e. sensors, which activate a connected camera, a video recorder and/or a plurality of alarms when an intruder object appears within the area of surveillance. The term "intruder object" is used to include any human, animal, or material object entering the surveillance area.

The above described systems are disclosed in U.S. Pat. Nos. 4,651,143; 5,495,288; 5,602,585; 5,825,413; and 5,455,561. The '585 patent discloses a specially developed camera with an active pixel imaging system, the imaging system being based on a complicated image analysis and processing. The '561 patent provides a security system utilizing a similarly complicated processing of a video signal, i.e., comparison, differentiation, assignment of the levels of activation, etc., to exclude false alarms. Likewise, the '413 patent also relates to the field of security and surveillance systems and it utilizes an infrared motion detector, a control unit and a video recording camera (camcorder). The '413 patent claims a combination of the infrared motion detector and at least one infrared signal-reflecting surface to cover a maximum area in the controlled, i.e., protected, zone. The control unit, turning the camcorder "on" and "off", has a sophisticated electronic circuitry generating a special code sequence. The '288 patent discloses a method of supplying power to a detector/sensor, TV camera and a VCR. The '143 patent utilizes a standard array of equipment (TV camera, sensor and VCR), which are installed in several positions within the controlled area. At the appearance of a trespasser, a sensor's signal turns the VCR on and, simultaneously, the same signal is conveyed to a monitoring site where an observer is located. The observer receives the alarm and checks the video recording to identify the cause of the alarm.

The present invention provides a household security and surveillance system, which, in the preferred embodiment, couples solenoids, located within a controller, with a remote control. Additionally, the preferred embodiment of the present system utilizes an ordinary household VCR. The present invention allows for a simpler and less expensive provision of a security system, as well as it's utilization in a typical household environment where the system can be used for surveillance inside the house as well as outside the house.

SUMMARY OF THE INVENTION

It is an object of the present invention to provide a household surveillance and security system.

It is another object of the present invention to provide a household surveillance and security system utilizing a household video recorder. In one preferred embodiment the video recorder is a household VCR.

It is a further object of the present invention to provide a household surveillance and security system which is cost effective and reliable.

Other objects, advantages and features of this invention will be more apparent hereinafter.

The above enumerated objects are accomplished by a surveillance system comprising a triggering device, connected to a controller, which, through a remote control, conveys activation and/or deactivation signals to a video recorder. In the preferred embodiment, the video recorder is a household VCR. This activation/deactivation scheme is enabled by coupling solenoids, located within the controller adapted to activate the "start" and/or "stop" buttons of the remote control. In another preferred embodiment of the present invention, the video recorder is connected to a video camera, providing surveillance of the protected area.

BRIEF DESCRIPTION OF THE DRAWINGS

A full understanding of the invention can be gained from the following description of the preferred embodiment when read in conjunction with the accompanying drawing in which.

DETAILED DESCRIPTION OF THE PREFERRED EMBODIMENTS AND THE DRAWINGS

Figure 1:
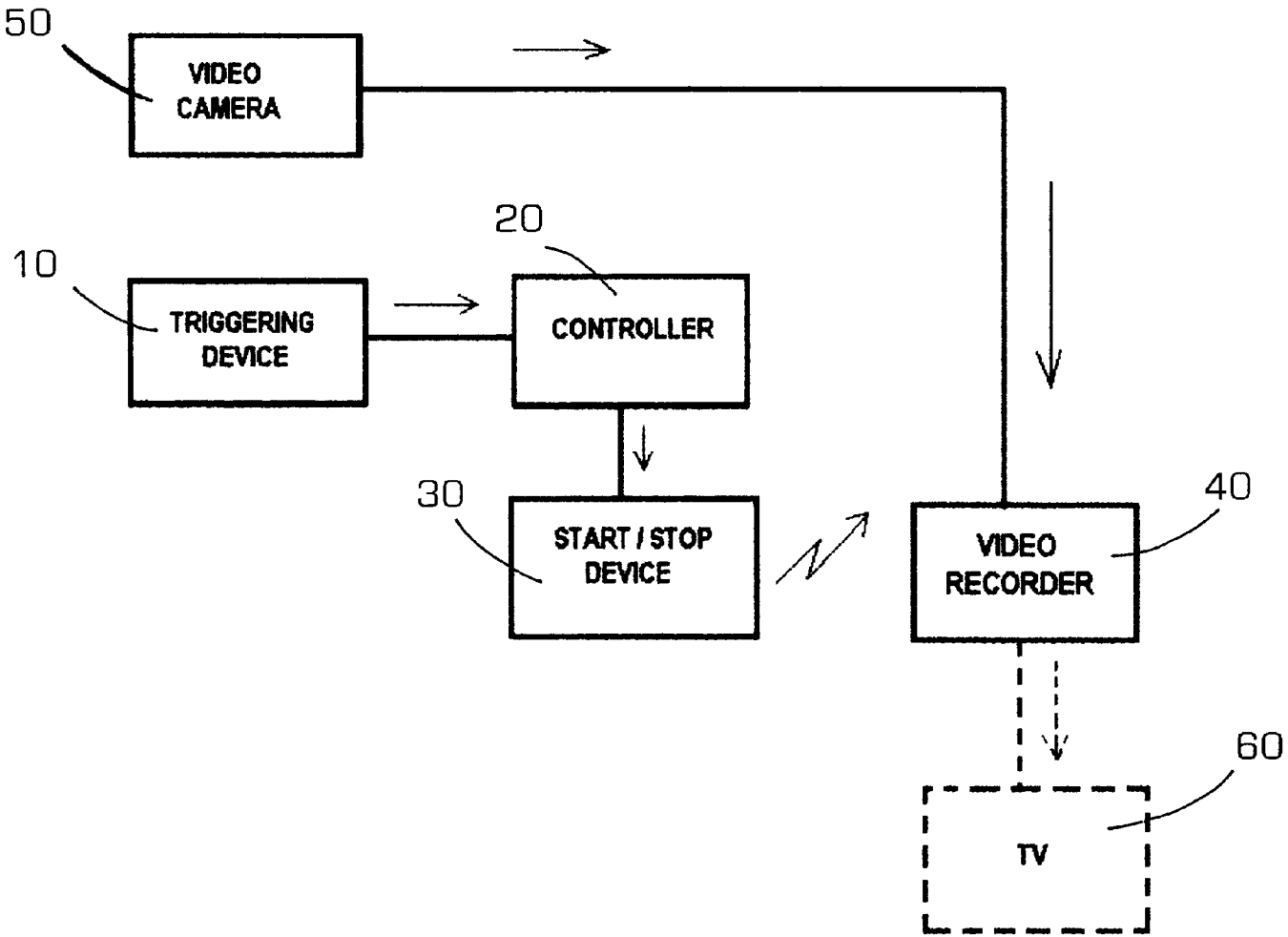
FIG. 1 is a schematic block diagram of the surveillance and security system provided in accordance with the present invention.

In accordance with the preferred embodiment of the present invention, shown in FIG. 1, the surveillance system is provided which preferably comprises the triggering device 10, connected to the controller 20, which conveys signals of activation or deactivation to the video recorder 40 through the start/stop device 30. One of the big advantages of the present invention is the ability to use a common household remote control as a device 30. Further description refers to the start/stop device as a remote control. The very remote control used with a particular VCR of the house is ideally suited for this purpose. So-called universal remote controls may also be used. In the preferred embodiment, the video recorder 40 is a household VCR. The video recorder 40 is preferably connected to the video camera 50, providing surveillance of the protected area. In another preferred embodiment of the present invention, a TV monitor 60 such as a household TV set may be connected to the video recorder 40 to preview the information received by the recorder. Different types of motion detectors, door switches, floor switches, door bells, etc. may be used as the triggering device signaling an appearance of an intruder object in the protected area. Controller 20 comprises solenoids L1 and L2 with corresponding plungers (not shown) and governing electrical circuitry. When these solenoids are activated, their plungers, i.e. cores, push on the "start" or the "stop" button of the regular and commonly known household remote control device. In one preferred embodiment, the electrical circuitry providing a "single-push" activation of the "start" button is utilized. An electrical circuitry allowing for a "double-push" activation of the "start" button may also be provided. Solenoids L1 and L2 may be rotary, tubular or any other similar type. Electrical circuitry of the single-push type may be used in connection with a remote control which can be activated by a single push of the "start" button. Correspondingly, a more complicated electrical circuitry allowing for a "double-push" activation, may be used with a certain kind of remote control requiring a double push of its "start" button for activation.

Controller 20 transforms an electrical trigger signal received from the triggering device 10 into a mechanical movement of the solenoids' plungers. These plunger movements accomplish the actual pushes of the "start" and "stop" buttons of the remote control placed in vicinity thereof. The physical design of the controller 20 is adapted preferably to receive a common remote control and provide for positioning the solenoids in appropriate places above the corresponding buttons of the remote control 30. Once the remote control 30 is positioned in working arrangement with the controller 20, the entire unit is then placed in such a way that the remote control 30 is capable of sending its signals to the video recorder 40. The "start" button of the remote control 30 sends an "on" signal to the video recorder 40 and the "stop" button sends an "off" signal to the video recorder 40. The "on" signal starts the recording and the "off" signals stops it. The "start" button is activated by provided circuitry when a trigger signal is generated by a triggering device 10 at the time an intruder object appears within the protected area or the area of surveillance. The "stop" button is preferably pressed within a predetermined time interval (such as two minutes, for example) after the intruder object leaves the area of the surveillance.

Figure 2:
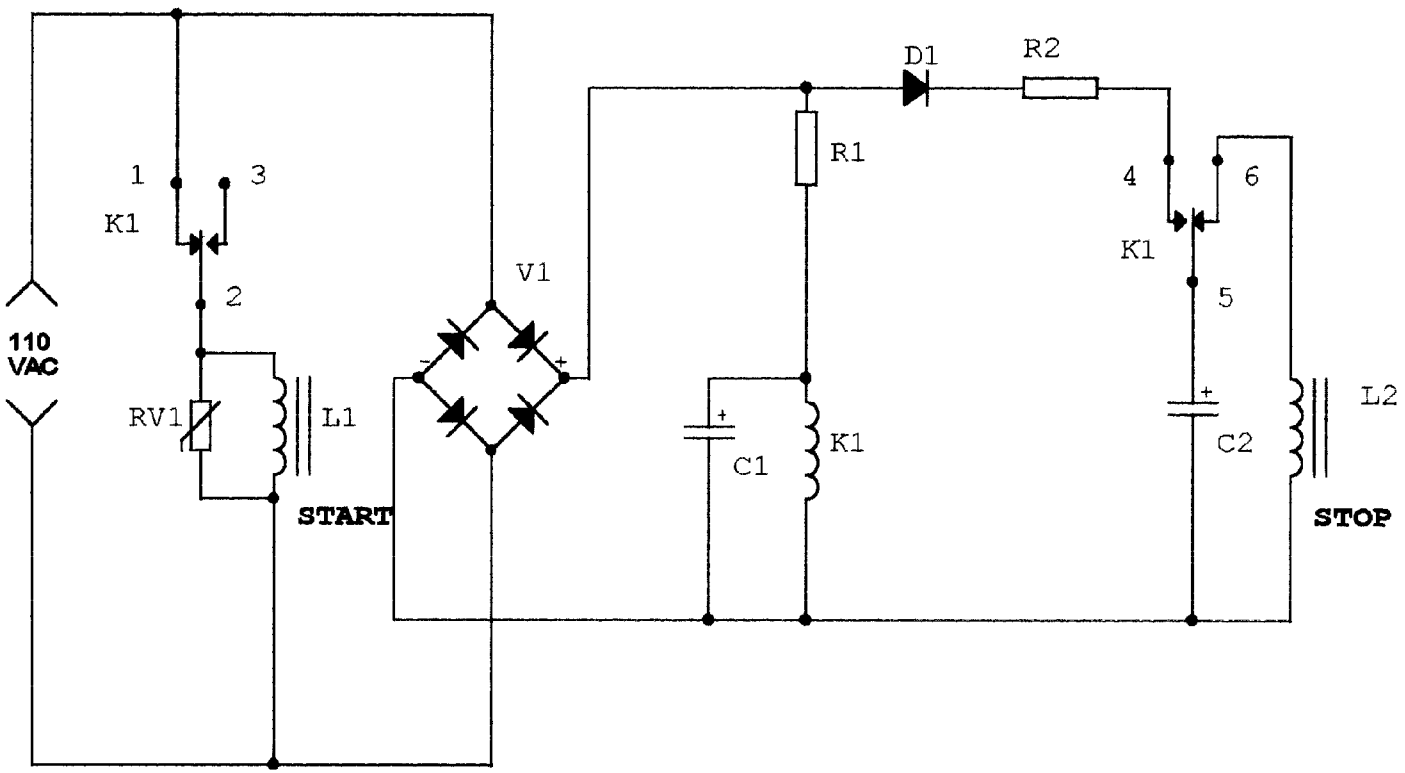
FIG. 2 is a schematic diagram of the electrical circuitry of the controller, enabling a "single-push" activation of a "start" button of the remote control.

FIG. 2 presents the electrical circuitry accomplishing the "single-push" activation of the "start" button of the remote control. The circuitry is powered by 110 VAC and comprises a coil of the solenoid L1, coupled with the varistor RV1, connected to the power source through the normally closed contacts 1 and 2 of the relay K1, and a bridge rectifier V1, connected to the same power source. Output of the bridge rectifier V1 is connected to the series circuit of the resistor R1 and the coil of the relay K1, coupled with the capacitor C1 in parallel. Also, a series connection of the diode D1, the resistor R2, the normally opened contacts 4 and 5 of the relay K1, and the capacitor C2 is connected to the output of the bridge rectifier V1. The coil of the solenoid L2 is coupled to the capacitor C2 in parallel through the normally closed contacts 6 and 6 of the relay K1. A DPDT-type relay may be optionally used with the electrical circuitry of the present invention.

In use of the "single-push" system, at the appearance of an intruder object within the protected area of the surveillance, the triggering device sends a signal to the input of the controller and then to the solenoid L1. In response to the signal, solenoid's plunger presses the "start" button of the remote control 30. The remote control 30, in turn, sends its "turn-on" signal to the household video recorder 40, preferably a VCR, which starts recording video information which it receives from the video camera 50. At the same time, through the bridge rectifier V1 and resistor R1 the capacitor C1 is charged. When its charge reaches a predetermined value, it activates the relay K1 which, in turn, opens contacts 1 and 2 and solenoid's plunger returns to its original position. At the same time, the capacitor C2 is connected to the charged circuitry of the bridge rectifier V1, diode D1 and resistor R2 through the normally closed contacts 4 and 5 of the relay K1. This condition of the circuitry remains the same during the entire presence of the signal from the triggering device 10, i.e., during the entire time of the recording.

When the intruder object leaves the protected area, triggering device 10 stops sending its signal that removes current from relay K1. All contacts of this relay return into their initial position and the capacitor C2 discharges through the solenoid L2. When the solenoid L2 is activated, the movement of its plunger presses the "stop" button of the remote control 30.

Figure 3:
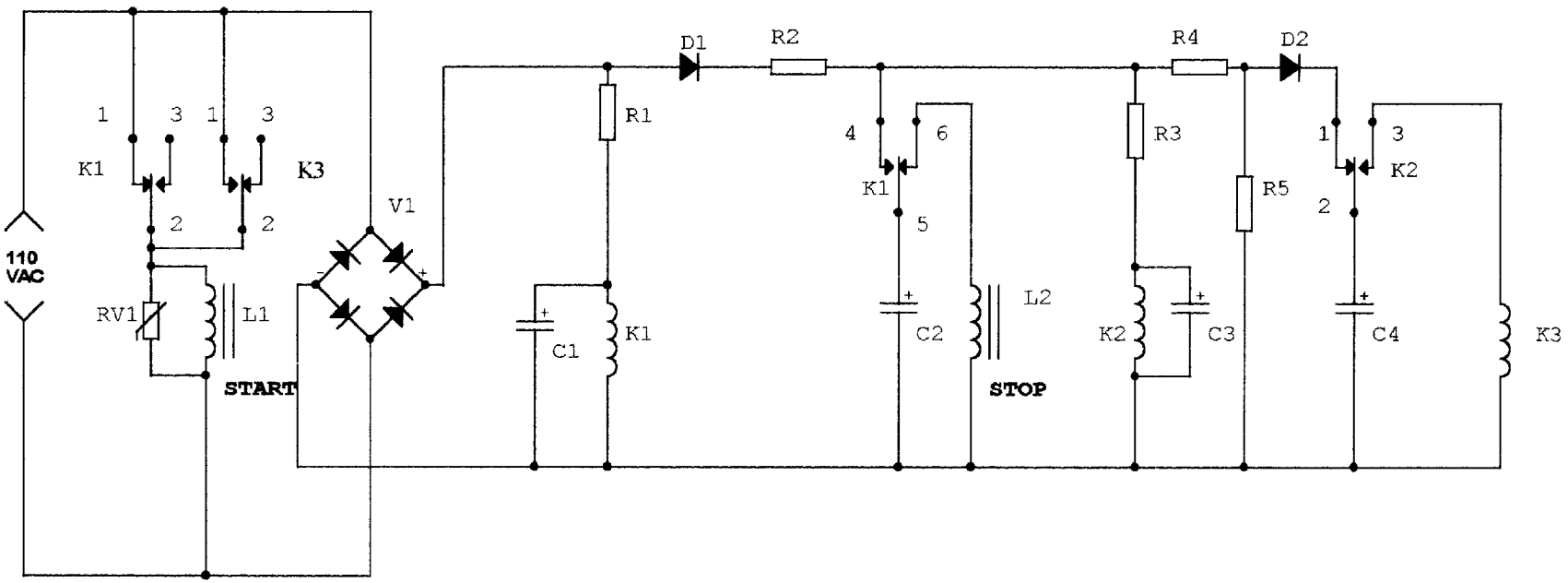
FIG. 3 is a schematic diagram of the electrical circuitry of the controller, enabling a "double-push" activation of a "start" button of the remote control.

FIG. 3 presents an electrical circuitry used to accomplish the "double-push" activation of the remote control 30 by pressing its "start" button twice. This electrical circuitry, similarly to the "single-push" circuitry described above, comprises a 110 VAC power source, a bridge rectifier V1, connected to the power source in parallel, and a coil of the solenoid L1, coupled with a varistor RV1. The varistor RV1 and the solenoid L1 are connected through the normally closed contacts 1 and 2 of the relay K1. Contacts 2 and 3 of the relay K1 are initially opened (disconnected). The circuitry of the resistor R1 and the coil of the relay K1, coupled with the capacitor C1, are connected to the output of the bridge rectifier V1 in parallel. Diode D1, resistor R2 and normally opened (disconnected) contact 4 of the relay K1 are connected in series. The "double-push" activation circuitry has additional elements not present in the described above "single-push" circuitry. These elements are as follows:

- an electrical circuitry of the resistor R3 and a coil of the relay K2, coupled with the capacitor C3, connected to the common point of the resistor R2 and the contact 4 of the relay K1 (a DPDT-type relay may also be optionally used in connection with the present invention);
- a voltage divider comprising resistors R4 and R5;
- a circuitry of the diode D2, normally closed, i.e. connected contacts 1 and 2 of the relay K2 and capacitor C4, all connected to the middle point of the above voltage divider; normally open contact 3 of the relay K2 connected in series with the coil of the relay K3;
- an additional relay K3 is also provided in this preferred embodiment. Its normally open contact 1 is connected to the 110 VAC power source, and its normally closed contacts 2 and 3 are connected to the contact 2 of the relay K1. An SPDT-type relay may be utilized as the K3 relay.

In use of the "double-push" electrical circuitry, an appearance of the intruder object within the protected area triggers the triggering device 10, which sends a corresponding signal to the solenoid L1. When the solenoid L1 is activated, its plunger presses onto the "start" button of the remote control 30. At the same time, charging of the capacitor C1 begins through the bridge rectifier V1 and the resistor R1. Simultaneously, the capacitor C3 and C4 are also charged. Since the time constant for R1C1 is less than the time constant of R3C3, the relay K1 is activated before the charge of the capacitor C3 reaches a threshold value. Consequently, contacts 1 and 2 of the relay K1 are opened, the solenoid L2 is deactivated and its plunger returns to its initial position; normally opened contacts 4 and 5 are closed and the capacitor C2 begins to be charged; when the charge of the capacitor C3 reaches a predetermined threshold value, it activates the relay K2. When relay K2 is activated, its contacts 2 and 3 close and the capacitor C4 (charged to the level capable of activating the relay K3) discharges through the coil of the relay K3. Solenoid L1 through the normally opened contacts 1 and 2 of the relay K3 is again connected to the power source and presses the "start" button the second time. When the capacitor C4 is completely discharged, relay K3 returns to its initial position and solenoid L1 is deactivated once again.

When the intruder object leaves the protected area, the signal of the triggering device is deactivated and, as a result, the relay K1 is deactivated as well returning all of its contacts into the initial position. The capacitor C2, through the normally closed contacts 2 and 3 of the relay K1, discharges through the solenoid L2. When the solenoid L2 is activated, its plunger presses the "stop" button of the remote control 30 and stops the recording.

Having described this invention with regard to specific embodiments, it is to be understood that the description is not meant as a limitation since further variations or modifications may be apparent or may suggest themselves to those skilled in the art. For example, the same device may be configured to turn on and off the video camera 50 only during the time of recording as opposed to leaving it on during the entire surveillance time. It is intended that the present application cover such variations and modifications as fall within the scope of the appended claims.

What I claim is:

1. A household security and surveillance system for surveillance of a protected area, said system comprising:

at least one triggering device configured to send a trigger signal when triggered by an intruder object appearing within said protected area;

a remote control means having a "start" manual button to send an "on" signal and a "stop" manual button to send an "off" signal;

a controller connected to said triggering device for receiving said trigger signals therefrom, said controller including a first solenoid and a second solenoid, said first solenoid adapted to interact with said "start" manual button to cause said remote control means to send an "on" signal, said second solenoid adapted to interact with said "stop" manual button to cause said remote control to send an "off" signal;

a video recorder configured to be turned on when said "on" signal is sent by said remote control means and to be turned off when said "off" signal is sent by said remote control means; and a video camera configured to provide a video signal to said video recorder and positioned to cover said protected area, wherein when said triggering device is triggered by said intruder object appearing within said protected area, said trigger signal is sent by said triggering device and received by said controller causing activation of said first solenoid and further causing said remote control means to send said "on" signal to turn on said video recorder;

wherein said triggering device stops sending said trigger signal when said intruder object leaves said protected area;

wherein said second solenoid is activated after a predetermined time since said trigger signal is no longer sent from said triggering device; and wherein activation of said second solenoid causes said remote control means to send said "off" signal to said video recorder.

2. A controller for a remote control, said remote control comprising a "start" button and a "stop" button, said "start" button configured to send an "on" signal when pressed, said "stop" button configured to send an "off" signal when pressed, said controller comprising:

an input means for receiving a trigger signal; and an activation means comprising a first solenoid, a second solenoid and a means for energizing thereof, said activation means adapted to interact with said remote control to cause said remote control to send said "on" and "off" signals in response to the presence or absence of said trigger signal, wherein said controller adapted to receive said remote control to place said first solenoid and said "start" button in operable relationship therebetween and correspondingly to place said second solenoid and said "stop" button in operable relationship therebetween.

* * * * *